US005839620A

United States Patent [19]

Battegazzore

[11] Patent Number: 5,839,620

[45] Date of Patent: Nov. 24, 1998

[54] ATOMIZER WITH SUCTION TUBE PROVIDED WITH BALLAST WEIGHT

[75] Inventor: Piero Battegazzore, Alessandria, Italy

[73] Assignee: Guala Dispensing S.r.l., Alessandria, Italy

[21] Appl. No.: 825,106

[22] Filed: Mar. 27, 1997

[30] Foreign Application Priority Data

Mar. 27, 1996 [EP] European Pat. Off. ..... 96830155

[51] Int. Cl.[6] ..... B67D 5/42

[52] U.S. Cl. ..... 222/382; 222/464.4

[58] Field of Search ..... 222/382, 464.4, 222/464.3

[56] References Cited

U.S. PATENT DOCUMENTS

| | | | |
|---|---|---|---|
| 3,667,655 | 6/1972 | Knieriem, Jr. | 222/464.4 |
| 4,830,235 | 5/1989 | Miler | 222/464.4 |
| 5,195,664 | 3/1993 | Rhea | 222/464.4 |
| 5,373,973 | 12/1994 | Foster | 222/382 X |
| 5,397,034 | 3/1995 | Wunsch | 222/382 X |
| 5,553,750 | 9/1996 | Foster | 222/382 X |

FOREIGN PATENT DOCUMENTS

| | | |
|---|---|---|
| 285040 | 10/1988 | European Pat. Off. . |
| 2700483 | 7/1994 | France . |

*Primary Examiner*—Kenneth Bomberg

*Attorney, Agent, or Firm*—Ostrolenk, Faber Gerb & Soffen, LLP

[57] ABSTRACT

An atomizer for liquids, operated manually by a lever with a trigger operating a dispensing pump with a flexible suction tube penetrating into the container in which the liquid to be sprayed is located, and having a ballast weight fixed to the suction tube. The atomizer comprises retaining structure, which can be released when required, in the form of a lever which keeps the ballast weight locked to the dispensing pump and the suction tube gathered up against the dispensing pump. The ballast weight retaining structure is released after the atomizer has been mounted on the container, once the latter has been filled. In this way the flexible suction tube is extended and can follow the ballast weight by gravity regardless of the orientation of the container. Before mounting on the container, the position of the ballast weight is locked to the dispenser and the retracted position of the flexible suction tube enables the atomizers to be handled without risk of entanglement of the suction tubes with the corresponding ballast weights.

13 Claims, 12 Drawing Sheets

ATOMIZER WITH SUCTION TUBE PROVIDED WITH BALLAST WEIGHT

The present invention relates to a manually operated atomizer for liquids comprising an operating member, a dispenser to suck the liquid from a container which can be grasped with one hand, connecting means to fix the dispenser to the neck of the said container, a suction connector on the dispenser facing the container, the said suction connector defining the vertical axis of the dispenser, a suction tube whose free end is immersed in the liquid in the container and whose other end is connected to the said suction connector of the dispenser, and a ballast weight connected to the free end of the said suction tube.

Atomizers for liquid, operated manually by means of a pump with a trigger or by means of a push button and a pressurized propellant, in which the liquid suction tube, penetrating into the container associated with the dispenser, is provided with a ballast weight, are known in the relevant art.

A ballast weight associated with a flexible suction tube, particularly at its free end, enables the suction aperture of the tube to be disposed permanently in the proximity of that area of the container in which the liquid to be sprayed gathers under the effect of gravity, making it possible not only to use up completely the whole dose of liquid in the container, but also to use the atomizer in an upside-down position, in other words with the container vertically above the dispenser.

Typical examples of atomizers of the known type mentioned above are illustrated and described in EP-A-0 285 040 and FR-A-2 700 483.

Although they solve the principal problem of completely sucking out the liquid and of sucking it out even in positions different from the usual one, the type of atomizer mentioned above has a serious disadvantage which in practice limits its use on a large scale.

As is known, when producing atomizers on a large scale, the dispensing unit with the corresponding suction tube is fitted to the container, after the container has been filled, by automatic assembly lines to which are conveyed, on the one hand the full containers, and on the other hand the dispensing units fitted with the corresponding operating means and suction tubes.

To permit fast production rates, the dispensing units with the corresponding suction tubes must also be disposed in advance on the corresponding assembly line by a procedure which is automated as far as possible.

Consequently, any entanglement of the suction tubes of the dispensing units has a detrimental effect on the rapid loading of the units on to the corresponding assembly lines.

The presence of a ballast weight integral with the free end of the suction tube not only increases the risk of entanglement of the tubes during storage, transport and handling of the dispensing units, but also increases the problems encountered in eliminating this risk, by comparison with the case of dispensing units with suction tubes not fitted with ballast weights.

For this reason, dispensing units with suction tubes fitted with ballast weights at their ends have not been widely used in the production of atomizers on a large industrial scale, in which, as stated previously, it is necessary to use highly automated installations.

The object of the present invention is therefore to provide an atomizer with a manually operated dispensing unit in which the suction tube is provided with a ballast weight but does not entail a risk of entanglement of the suction tubes when the dispensing units are stored and transported together to be conveyed to assembly lines for fitting to the containers after the containers have been filled with the liquid to be sprayed.

The object is achieved by the atomizer of the type specified in the introduction, characterized in accordance with the claims which will follow.

The invention will now be described in greater detail with reference to certain preferred embodiments, provided solely for information and without restriction, illustrated in the attached drawings, in which.

Figure 1:
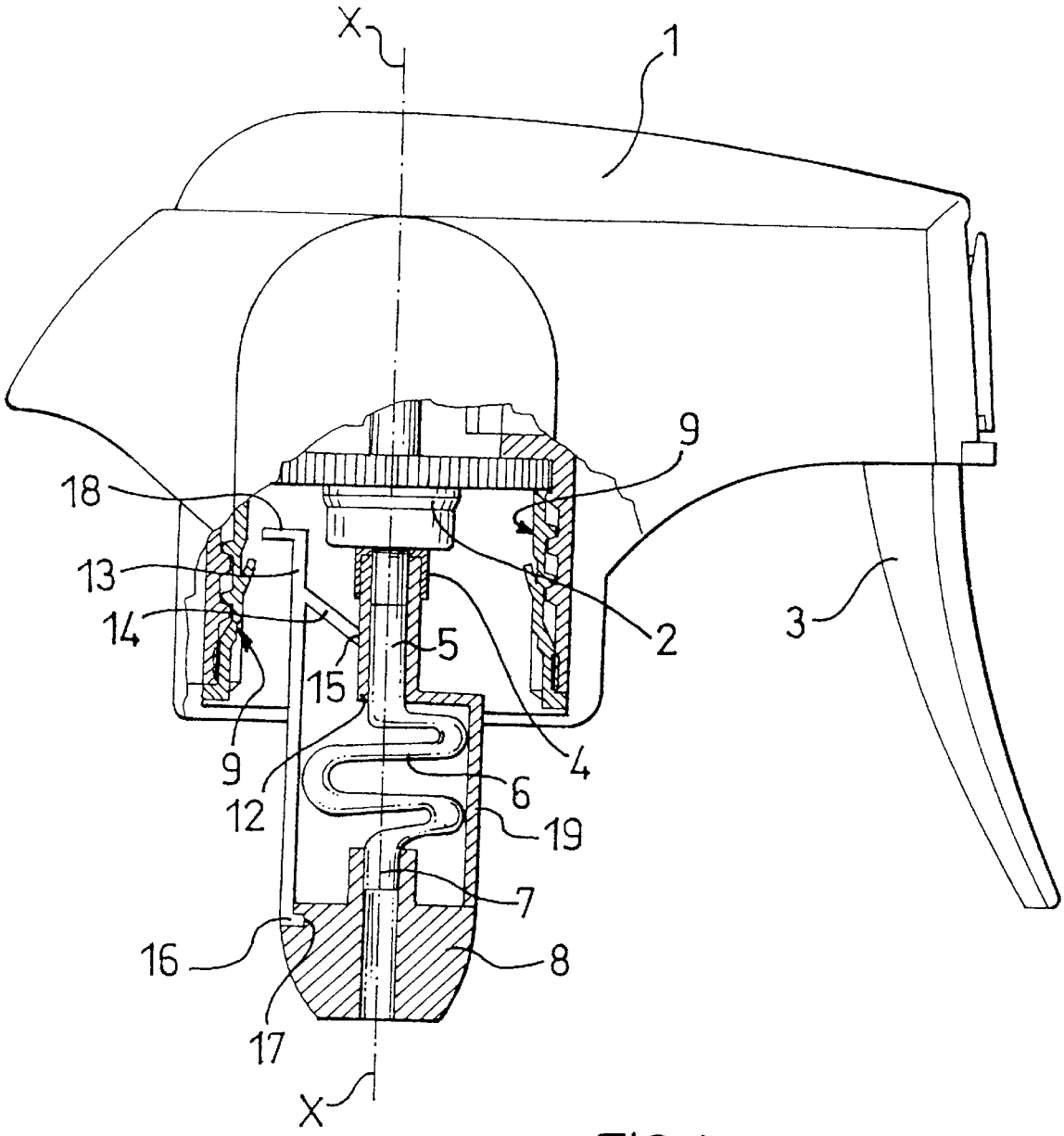
FIG. 1 shows, partially in section, an atomizer with a first embodiment of the ballast weight retaining means, with the ballast weight locked to the dispenser and with the suction tube in the retracted position.
Figure 2:
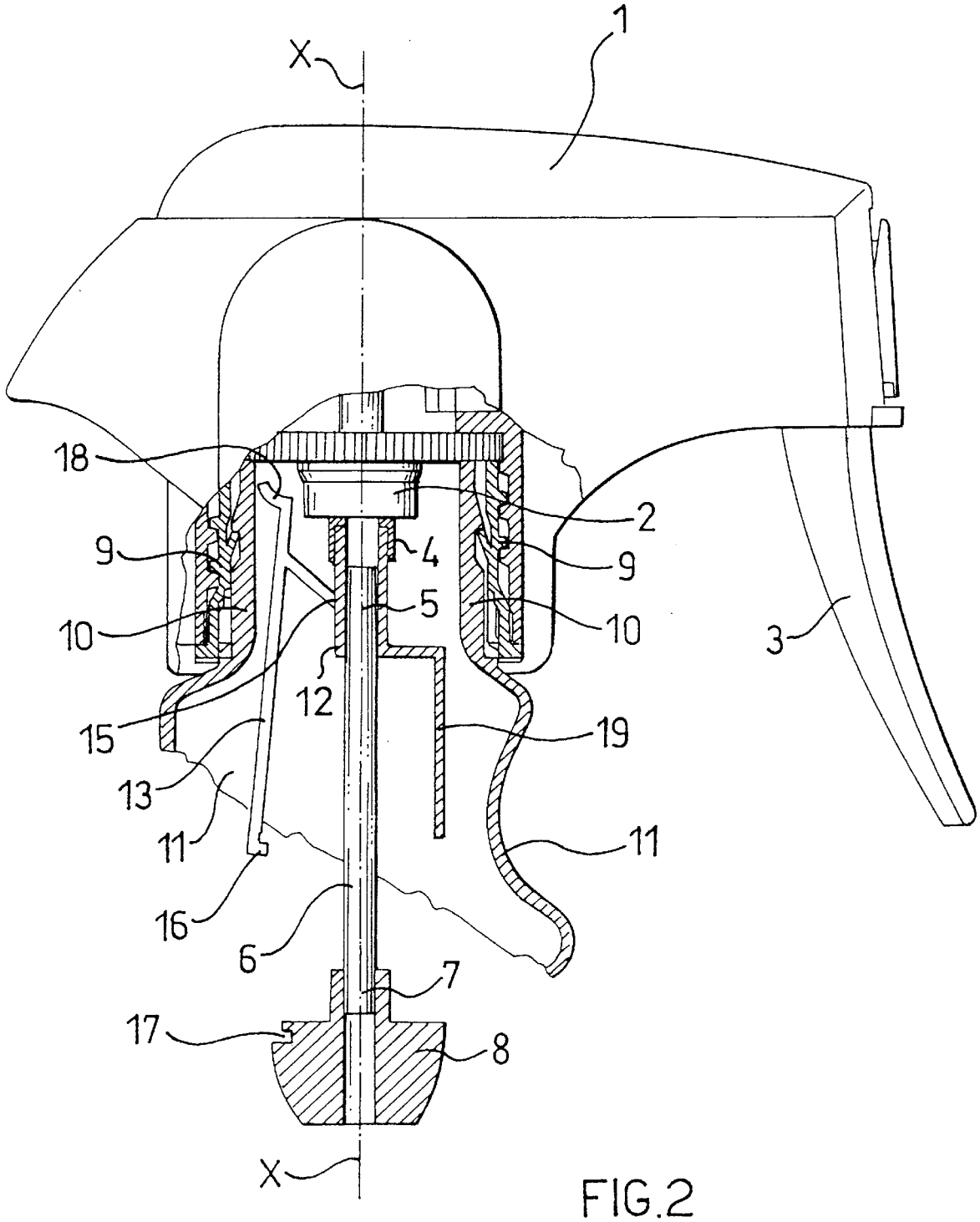
FIG. 2 shows the embodiment shown in FIG. 1, with the ballast weight released and the suction tube in the extended position.
Figure 3:
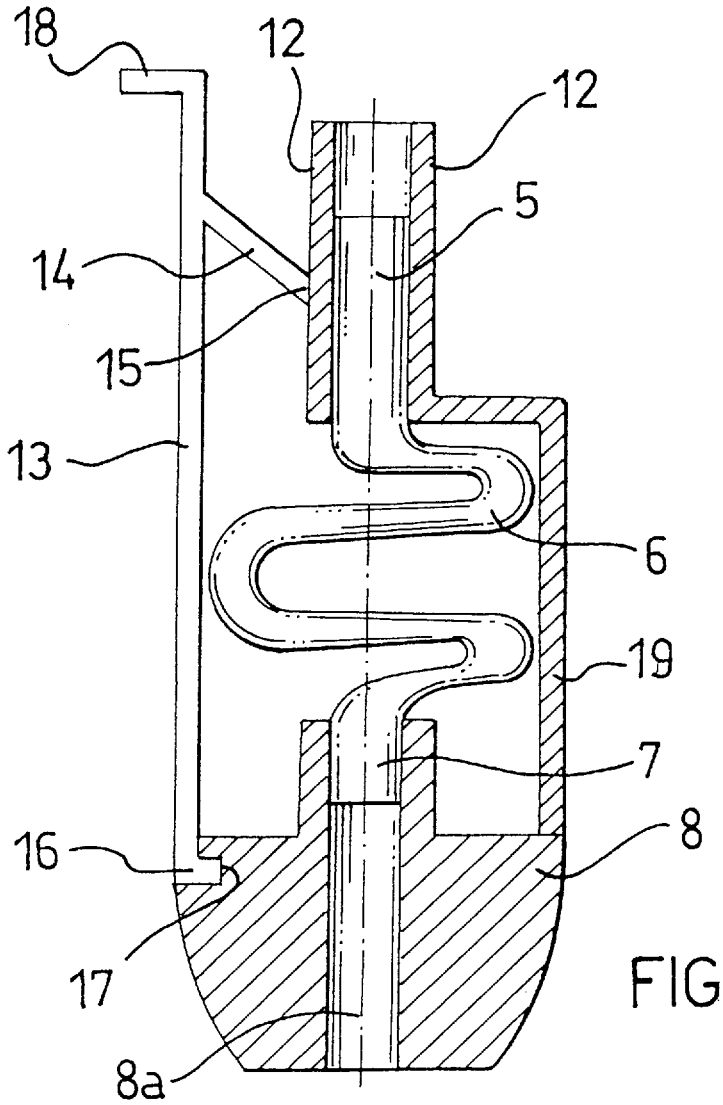
FIG. 3 shows a view in enlarged vertical section of the ballast weight and of the retaining means of the embodiment shown in FIG. 1.

With reference to the above figures and to FIGS. 1, 2 and 3 in particular, the number 1 indicates, as a whole, an atomizer provided with a dispenser 2 which, in this specific case, is in the form of a pump operated manually by a trigger 3 in a way which is wholly conventional and known in the relevant art.

The dispenser 2 is provided with a suction connector 4 connected to the end 5 of a suction tube 6 whose other end 7 is provided with a ballast weight 8 with an axial passage 8*a*.

The atomizer 1 comprises conventional means 9 for connection to the neck 10 of a container 11 in which is placed the liquid to be sprayed.

A first lever member 13 is connected to the dispenser 2 by the interposition of a tubular extension 12 fixed to the suction connector 4.

This member is connected to the tubular extension 12 and consequently to the dispenser 2 by means of a stem 14 which enables it to swing about the connection point 15.

The end 16 of the said lever member 13 is in the shape of a hook and is releasably inserted into a groove 17 formed on the outer profile of the ballast weight 8.

Consequently, when the said end 16 is engaged in the groove 17, the ballast weight is locked to the dispenser 2.

The opposite end 18 of the lever member 13 is disposed at a point where it meets the neck 10 of the container 11 when the atomizer is fitted to the container at the end of the filling operation.

As may be seen in FIG. 2, the meeting of the neck 10 with the end 18 of the lever 13 causes the lever to swing about the connection point 15 and therefore causes the hook end 16 to move out of the groove 17 of the ballast weight.

The ballast weight falls by gravity inside the container 11, extending the tube 6 which was originally retracted towards the dispenser 2, as may be seen in FIG. 1.

The means of retaining the ballast weight 8 on the body of the dispenser 2, represented primarily by the lever member 13, are completed by the rod member 19 disposed opposite the member 13 with respect to the axis X—X of the dispenser coinciding with and defined by the axis of the suction connector 4.

The said rod member 19 forms a stop for the stable positioning of the ballast weight when the latter is locked to the dispenser 2.

In the example illustrated in FIG. 1, the rod member 19 is integral with the tubular extension 12.

Figure 4:
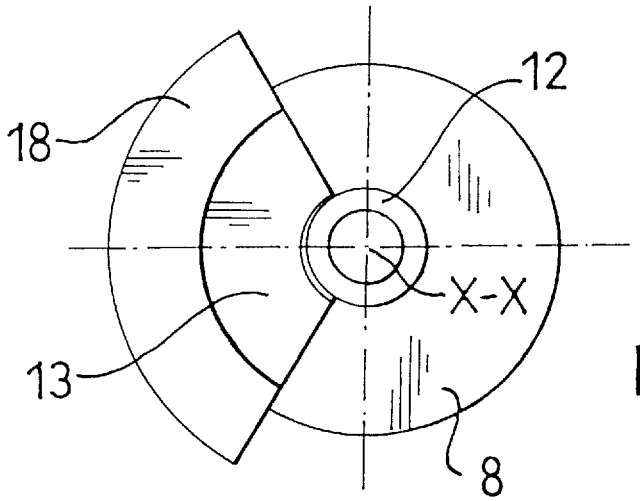
FIG. 4 shows a view from above of the device shown in FIG. 3.
Figure 5:
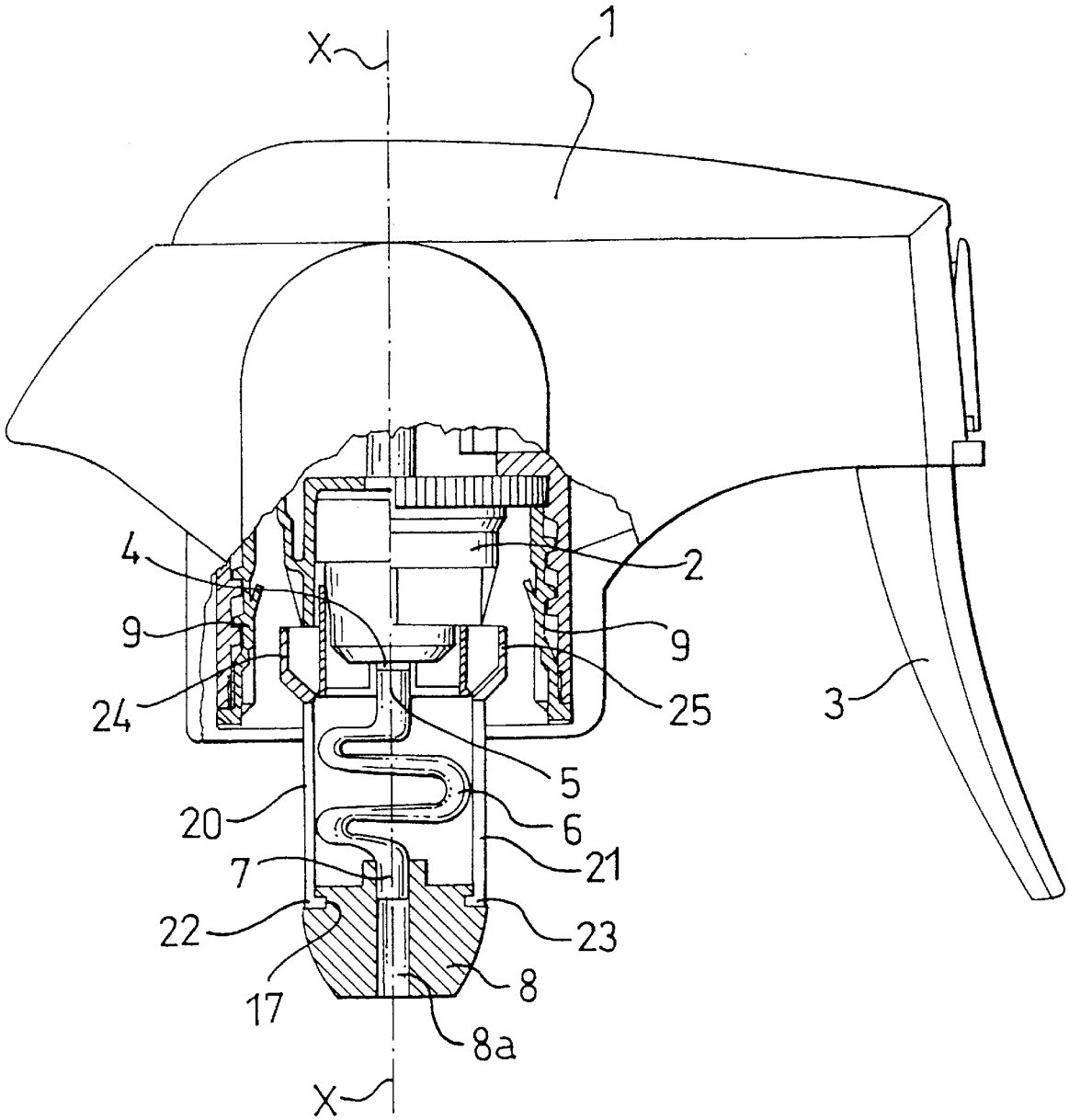
FIG. 5 shows, partially in section, an atomizer of the type shown in FIG. 1 with a second embodiment of the ballast weight retaining means, with the ballast weight locked to the dispenser and the suction tube in the retracted position.
Figure 6:
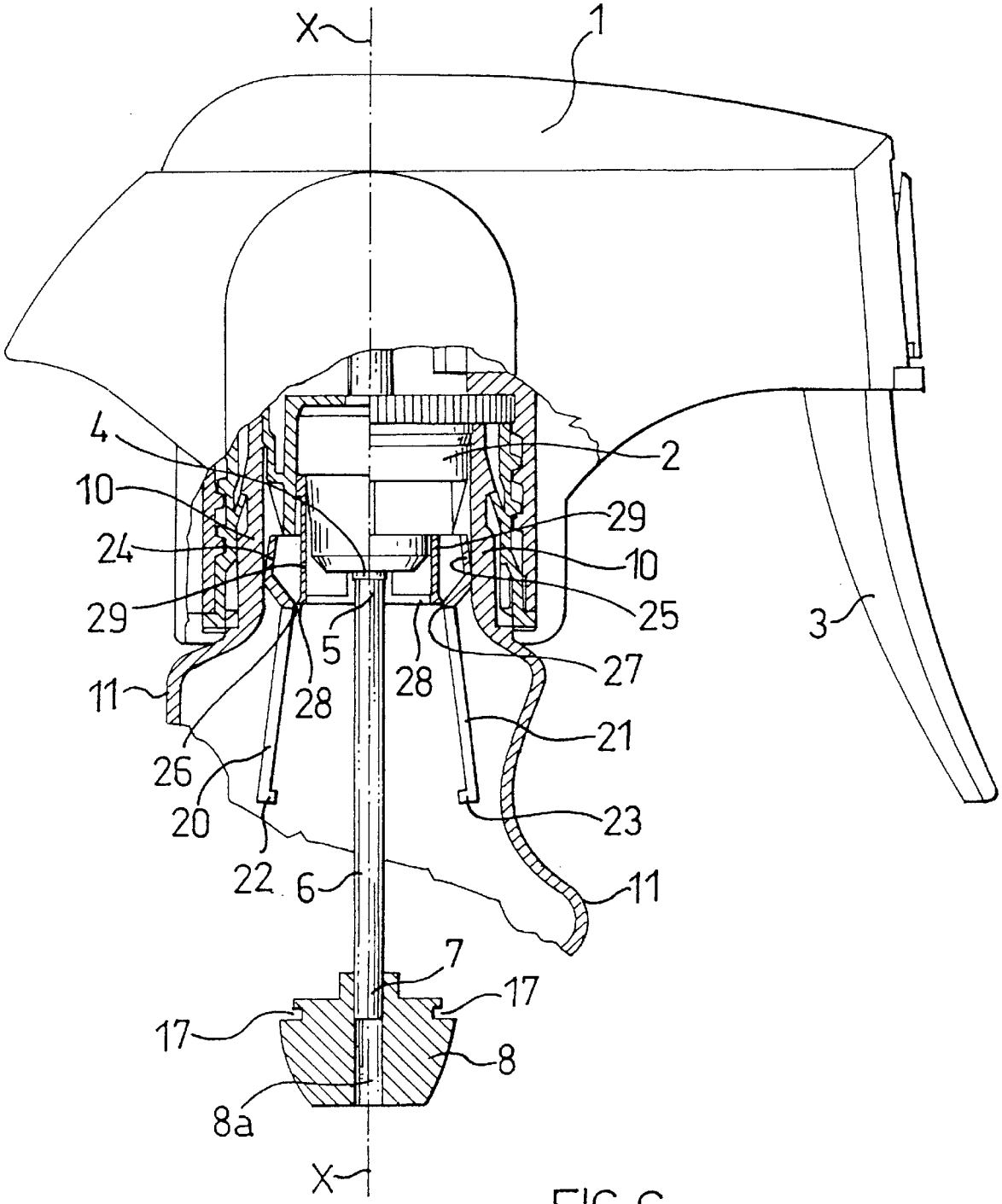
FIG. 6 shows the atomizer shown in FIG. 5, with the ballast weight retaining means released and the suction tube in the extended position.
Figure 7:
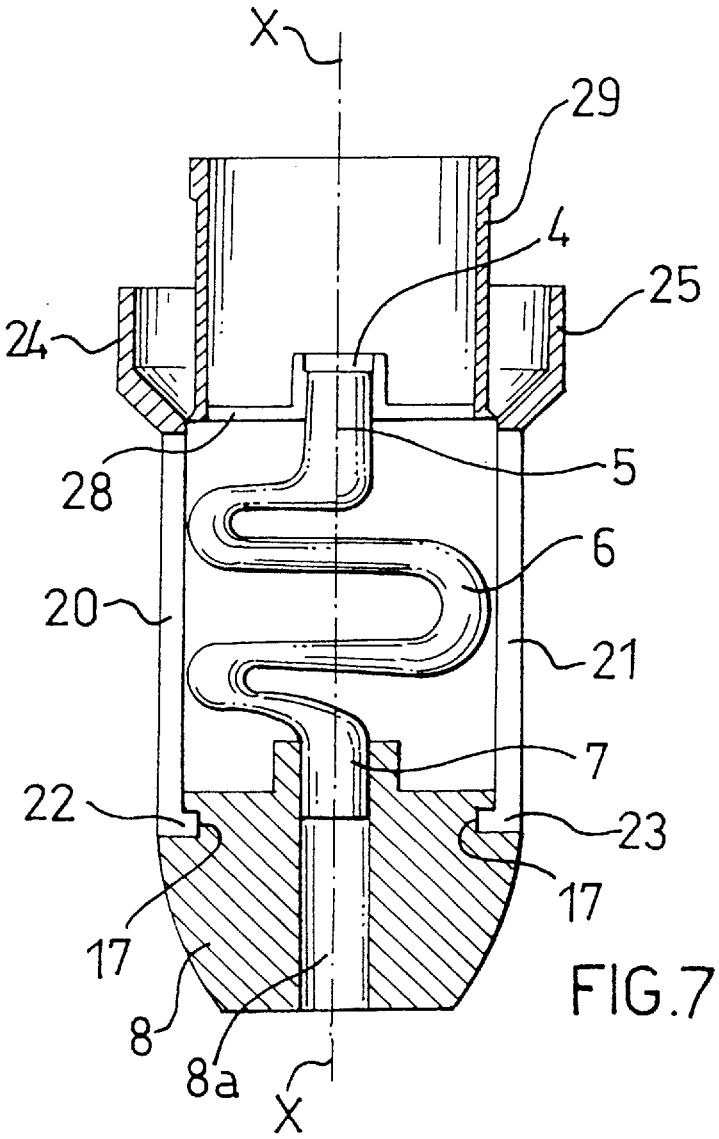
FIG. 7 shows a view in vertical section of the balance weight retaining means shown in FIG. 5 on an enlarged scale.

The lever member 13, as may be seen in FIG. 4, has a substantial transverse extension sufficient to enclose, at least partially, the suction tube 6 when this is gathered up and retracted towards the dispenser 2.

In this way, the functions of the flexible suction tube 6 with its ballast weight 8 are made available after the atomizer 1 has been fitted to the container 11, but before this fitting, during all the handling of the atomizer units, there is no risk of entanglement of the suction tubes 6 which are compacted, protected and gathered up against the dispenser 2.

With reference to FIGS. 5, 6, 7 and 8, in an atomizer 1 such as that described with reference to FIG. 1 and provided with a dispenser 2 in the form of a pump operated by a trigger 3, a second embodiment of the ballast weight 8 retaining means is shown.

These retaining means consist of a pair of lever members 20 and 21 whose ends 22 and 23 are in the form of hooks and are releasably inserted into corresponding grooves 17 in the ballast weight 8.

The opposite ends 24 and 25 of the said lever members are disposed in the proximity of the means 9 for connecting the atomizer 1 to the neck 10 of the container 11.

Each lever member 20 and 21 is also connected at point 26 and 27 respectively, these points being intermediate with respect to the longitudinal extension of the members, to the rim 28 of a collar 29 which is integral with the dispenser 2.

The lever members 20 and 21 can therefore swing about the points 26 and 27 and therefore, when the atomizer 1 is mounted on the container 11, the neck 10 of the container, meeting the ends 24 and 25, causes the release of the ballast weight 8 and the extension of the suction tube 6.

Figure 8:
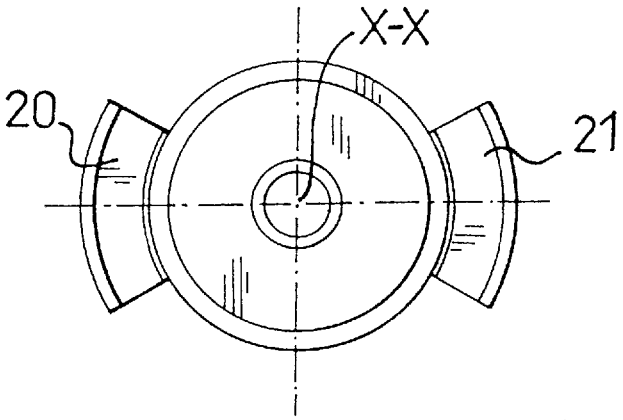
FIG. 8 shows a view from above of the device shown in FIG. 7.

In this embodiment too, the lever members 20 and 21 have substantial transverse extensions, as shown in FIG. 8, so that they enclose, at least partially, and protect the suction tube 6 when it is gathered up against the dispenser 2.

Figure 9:
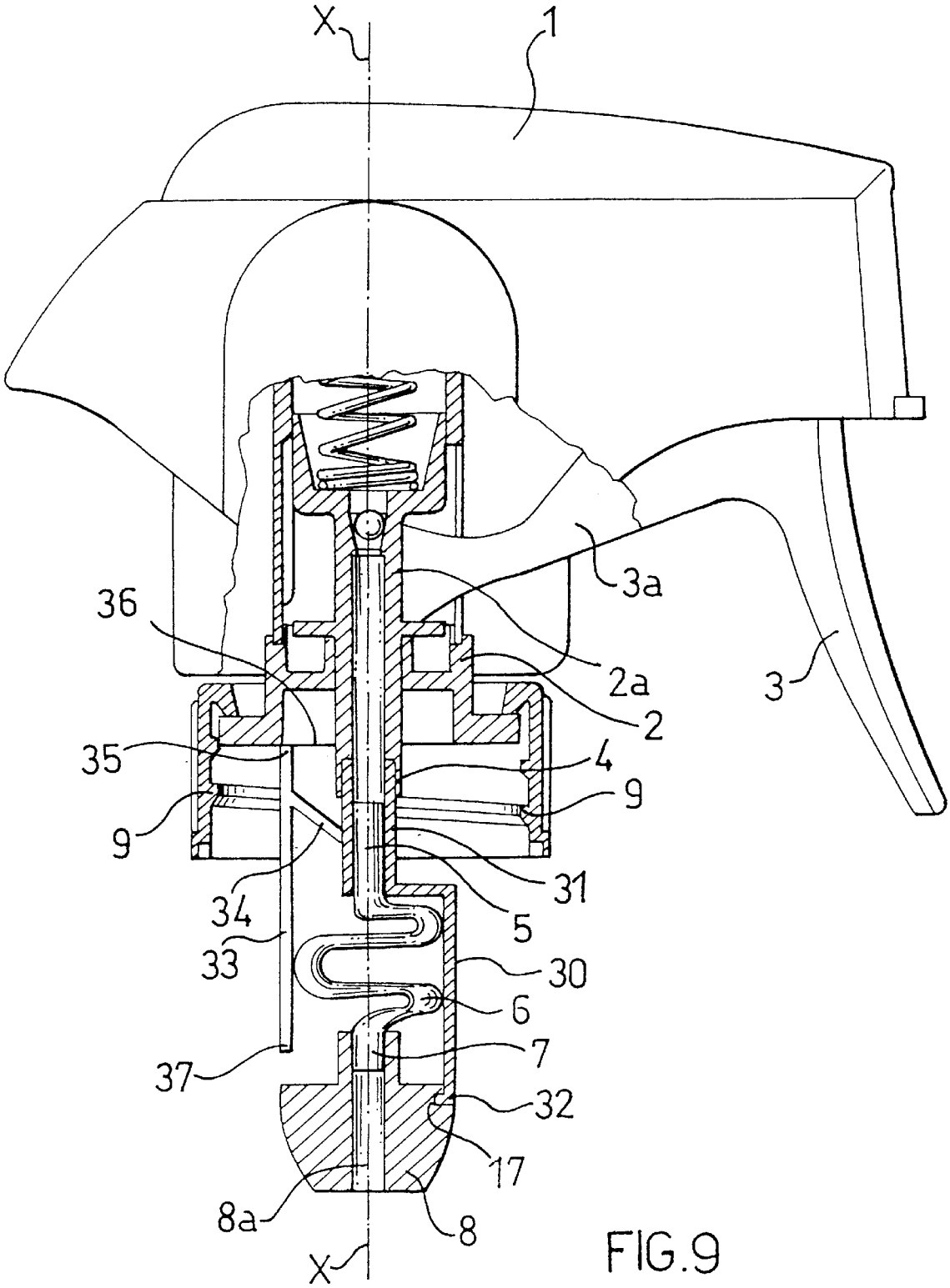
FIG. 9 shows, partially in section, an atomizer with a pump dispenser operated by a trigger lever and with a third embodiment of the ballast weight retaining means, with the ballast weight locked to the dispenser and with the suction tube in the retracted position.
Figure 10:
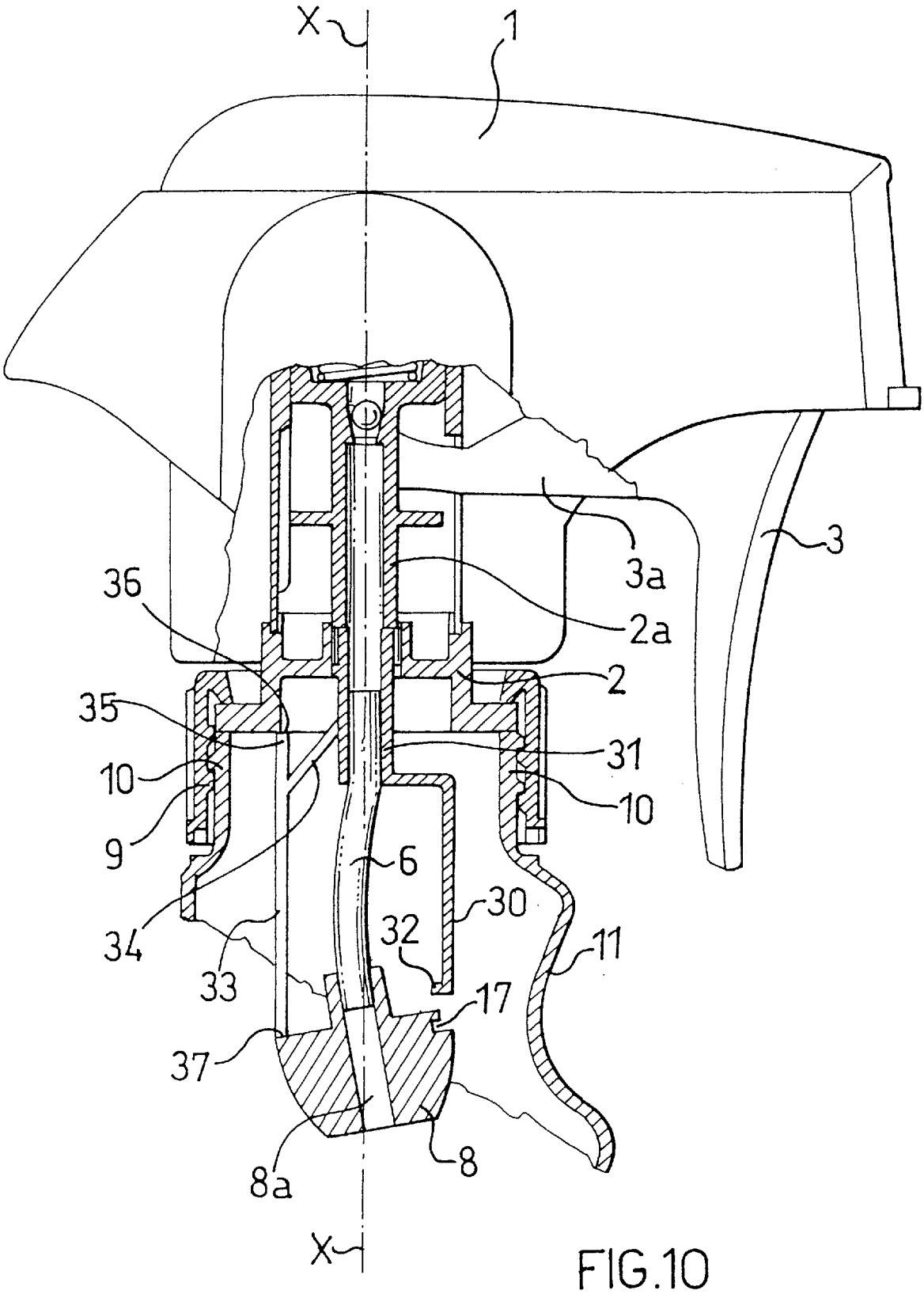
FIG. 10 shows the atomizer shown in FIG. 9 with the ballast weight released and the suction tube in the extended position.
Figure 13:
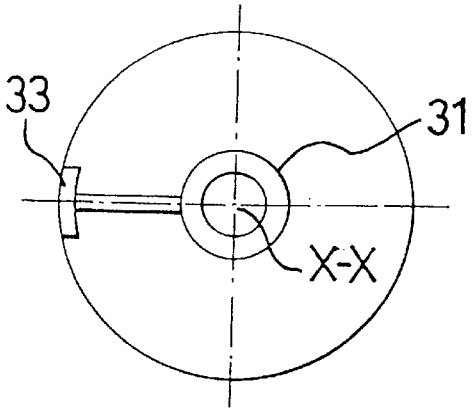
FIG. 13 shows a view from above, in the direction of the arrows F, of the device shown in FIG. 11.
Figure 11:
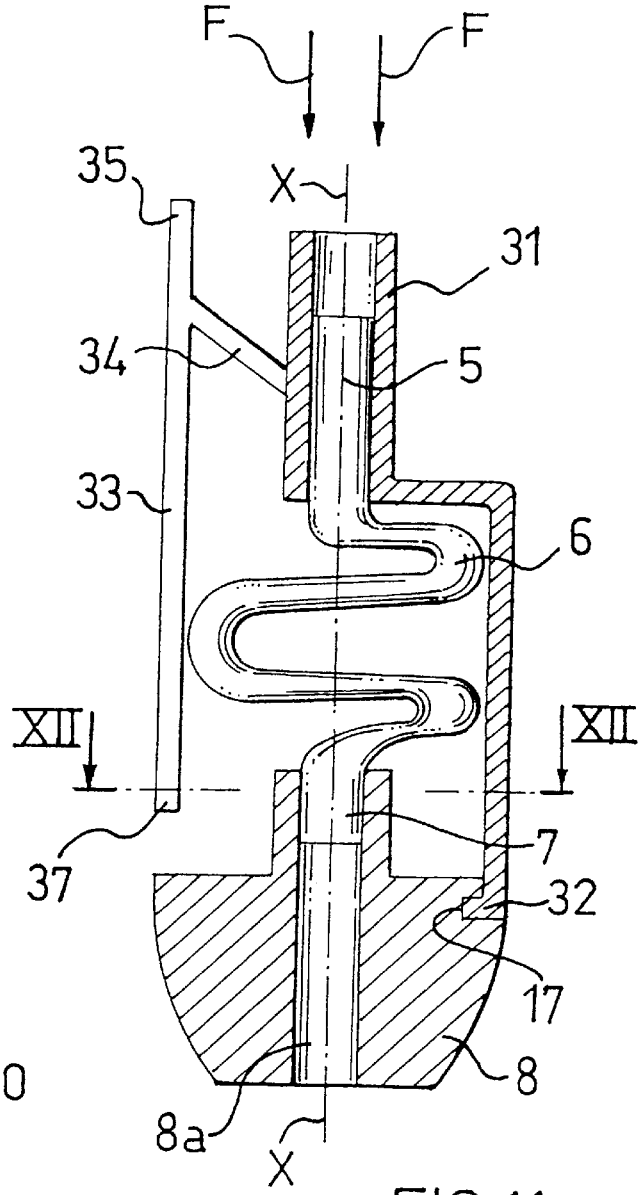
FIG. 11 shows a view in vertical section of the ballast weight retaining means shown in FIG. 9, on an enlarged scale.

With reference to FIGS. 9 to 11, the atomizer 1 is provided with a pump dispenser 2 whose piston 2*a* is moved axially by the branch 3*a* of a trigger 3.

This atomizer is provided with ballast weight 8 retaining means illustrated in their third embodiment.

These comprise a first rod member 30 connected, at one end, through a tubular extension 31, to the connector 4 of the dispenser 2 and consequently made integral with the dispenser.

At the other end, the rod member 30 is provided with a hook 32 which engages releasably in a corresponding groove 17 in the ballast weight 8.

Since the connector 4, in the illustrated example of a dispenser, is moved axially when the dispenser is operated, the rod member 30 and the ballast weight, when it is connected to this member, are also moved axially.

At the opposite end with respect to the longitudinal axis X—X, the hook means according to the present embodiment have a second rod member 33 connected by means of a stem 34 to the tubular extension 31.

The rod member 33 which, in the example illustrated, is rigid, has its end 35 bearing on the outer wall 36 of the dispenser 2.

Its opposite end 37 is instead disposed at a point where it interferes with the trajectory of the ballast weight 8 so that it comes into contact with the weight when, when operating the dispensing pump 2 by the trigger 3 for the first time, it is moved axially together with the rod member 30.

The striking of the ballast weight 8 against the free end 37 of the rod member 33, as illustrated in FIG. 10, causes the ballast weight 8 to be tilted and causes the hook end 32 to be disengaged from the groove 17.

Figure 12:
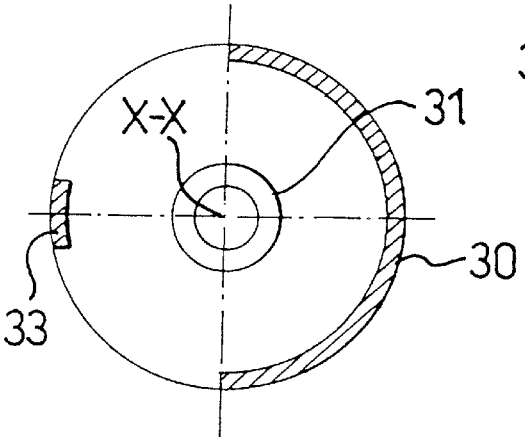
FIG. 12 shows a view in transverse section taken through the line XII—XII of FIG. 11.

In this embodiment too the rod member 30 has a substantial transverse extension, as illustrated in FIG. 12, which encloses and protects the suction tube 6 when this is retracted towards the dispenser 2.

Figure 14:
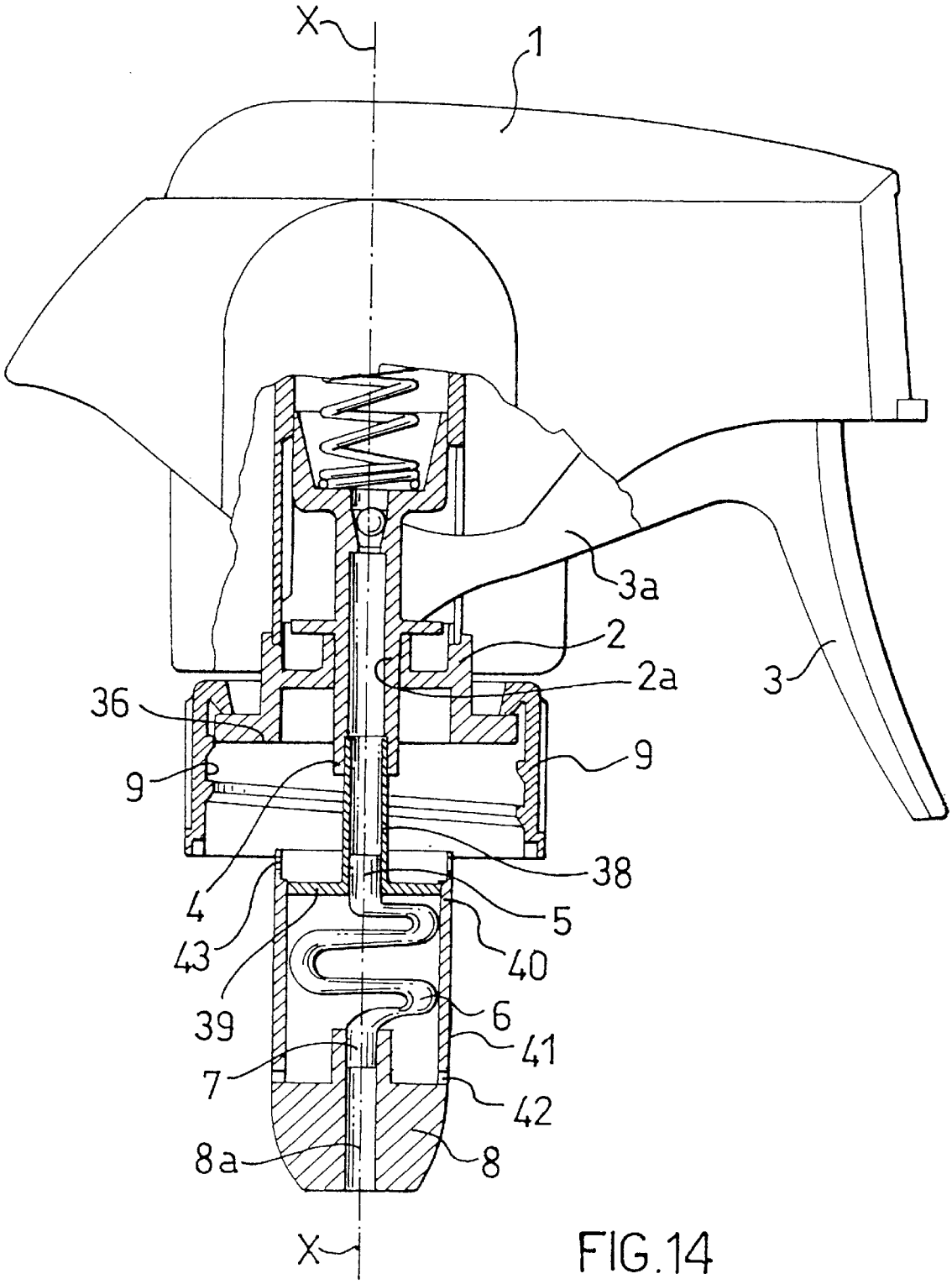
FIG. 14 shows an atomizer as shown in FIG. 9 with a fourth embodiment of the ballast weight retaining means, with the ballast weight locked to the dispenser and the suction tube in the retracted position.
Figure 15:
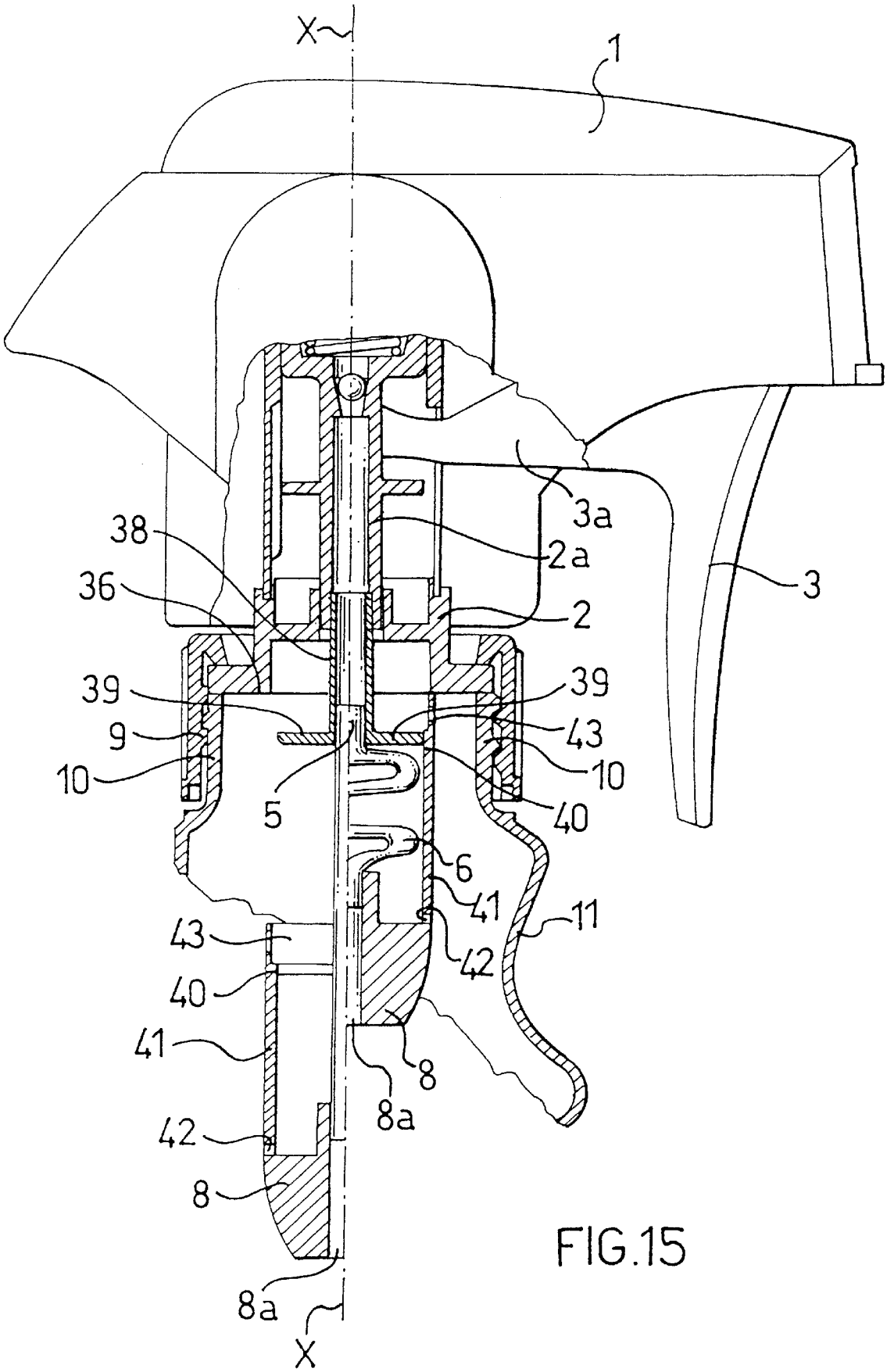
FIG. 15 shows an atomizer as shown in FIG. 14 with the ballast weight retaining means in the position immediately preceding the release (right-hand side of the figure) and in the released position with the suction tube extended (left-hand side of the same figure)
Figure 16:
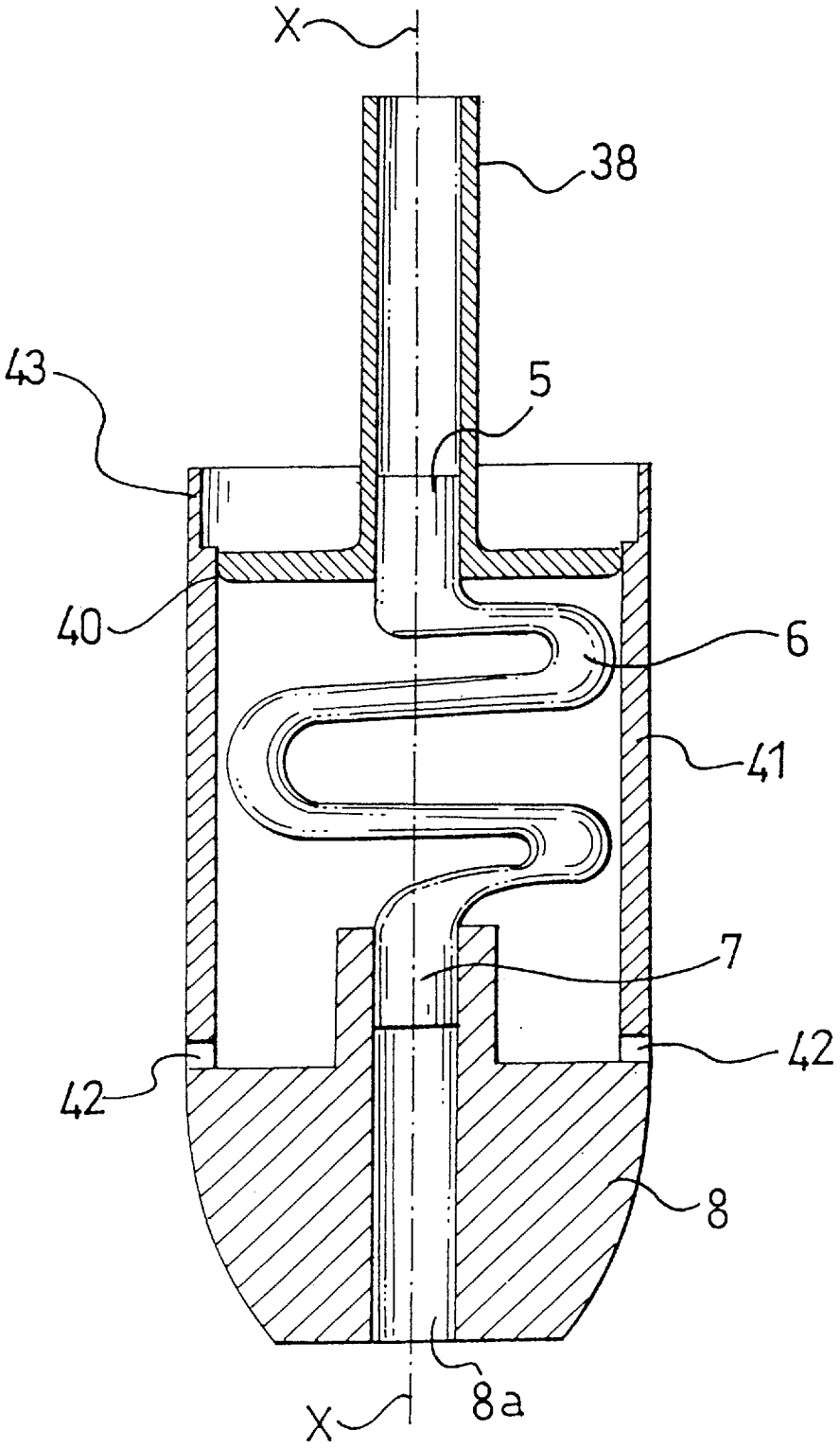
FIG. 16 shows in vertical section and on an enlarged scale the ballast weight retaining means of the embodiment shown in FIG. 14.

FIGS. 14 to 16 show a fourth embodiment of the ballast weight 8 retaining means, described with reference to a type of pump dispenser such as that illustrated in FIGS. 9 and 10.

These means comprise a first tubular member 38 connected to the suction connector 4 of the dispenser 2 and to the end 5 of the suction tube 6.

This tubular member 38 is provided with a flange 39 at the point of connection to the suction tube 6.

The rim of this flange is detachably connected to the first end 40 of a second tubular member 41 whose opposite end 42 is integral with the ballast weight 8.

The second tubular member 41 is also provided with a collar 43 facing the suction connector 4 and the outer wall 36 of the dispenser 2.

As may be seen in FIG. 15, when the dispenser is first operated, the axial movement of the first tubular member 38 initially causes the collar 43 to approach the outer wall 36 of the dispenser 2 and then, with the completion of the axial movement, causes the flange 39 to become detached from the end 40 of the second tubular member 41.

This second tubular member, together with the ballast weight 8, is free inside the container 11, causing the suction tube 6 to be extended.

Once again, the advantage is obtained of having the suction tube and the ballast weight grouped together and fixed to the dispenser during the handling of the atomizer, followed by the release of both after mounting on the container, thus avoiding the disadvantages arising from the risk of entanglement of the suction tubes carrying the ballast weights.

I claim:

1. Manually operated atomizer for liquids comprising an operating member, a dispenser to suck the liquid from a container which can be grasped with one hand, connecting means to fix the dispenser to the neck of the said container, a suction connector on the dispenser facing the container, the said suction connector defining the vertical axis of the dispenser, and a suction tube whose free end is immersed in the liquid in the container and whose other end is connected to the said suction connector of the dispenser, and a ballast weight connected to the free end of the said suction tube, the said suction tube being retractable and extendable, retaining means, which can be released when required, engaged with the said ballast weight to keep, when engaged, the said tube retracted towards the dispenser and the said ballast weight locked to the dispenser.

2. Atomizer according to claim 1, wherein said retaining means, which can be released when required, comprise at least one lever member of predetermined axial length connected, at an intermediate point, to the said dispenser in such a way that the lever can swing, one portion of one end of the lever meeting the neck of the container when the said connecting means are fixed to the container, while the opposite end is engaged releasably with the said ballast weight.

3. Atomizer according to claim 1, wherein said retaining means also comprise a rigid rod member, opposite the said swinging lever member, with reference to the said vertical axis of the dispenser, fixed to the said dispenser and forming a stop with its free end for the said ballast weight when this is locked to the dispenser.

4. Atomizer according to claim 1, wherein the said retaining means comprise a pair of lever rod members opposite each other with respect to the vertical axis of the dispenser, and connected to the said dispenser in such a way that they can swing.

5. Atomizer according to claim 4, wherein said lever rod members have a substantial transverse extension enclosing at least partially the said suction tube when this is retracted towards the dispenser.

6. Atomizer according to claim 1, wherein said retaining means comprise a first rod member connected, at one end, rigidly to the said dispenser and, at the other end, to the said ballast weight by means of a releasable hook member, the said first member extending in a direction substantially parallel to the vertical axis of the dispenser and being movable rigidly axially together with the said dispenser during the operation of the latter, and a second rod member, opposite the first with respect to the said vertical axis of the dispenser, remaining stationary with respect to the dispenser, the said second member having one end disposed inside the container at a point where it interferes with the trajectory of the ballast weight and acts as a stop to cause the detachment of the weight from the said releasable hook member at the time of the first operation comprising an axial movement of the dispenser.

7. Atomizer according to claim 6, wherein said first rod member has a substantial transverse extension enclosing at least partially the said suction tube when this is retracted towards the dispenser.

8. Atomizer according to claim 1, wherein said releasable retaining means comprise a first rigid tubular member connected at one end to the said suction connector of the dispenser and at the other end to the said retractable and extendable tube penetrating into the container, the said first tubular member being provided with a flange at the end connected to the said retractable and extendable tube, a second rigid tubular member having one end integral with the said ballast weight and the other end releasably connected to the said flange, the said second tubular member being also provided with a collar extending axially towards the said suction connector, the said collar forming a stop which meets the said dispenser at the time of the first operation comprising a movement of the dispenser in such a way as to cause the detachment of the said second tubular member from the said flange and consequently the extension of the said tube.

9. Atomizer according to claim 1, wherein said retractable and extendable suction tube consists of a flexible and bendable tubular member.

10. Atomizer according to claim 1, wherein said dispenser is a pump operated by a trigger.

11. Atomizer according to claim 2, wherein said retaining means also comprise a rigid rod member, opposite the said swinging lever member, with reference to the said vertical axis of the dispenser, fixed to the said dispenser and forming a stop with its free end for the said ballast weight when this is locked to the dispenser.

12. Atomizer according to claim 2, wherein the said retaining means comprise a pair of lever rod members opposite each other with respect to the vertical axis of the dispenser, and connected to the said dispenser in such a way that they can swing.

13. Atomizer according to claim 12, wherein said lever rod members have a substantial transverse extension enclosing at least partially the said suction tube when this is retracted towards the dispenser.

* * * * *